US005565730A

United States Patent [19]

Pollner et al.

[11] Patent Number: 5,565,730

[45] Date of Patent: Oct. 15, 1996

[54] ELECTRICALLY CONDUCTING SEALING COMPOUND FOR SPARK PLUGS

[75] Inventors: Rudolf Pollner, Bamberg; Alfons Scheuring, Memmelsdorf, all of Germany

[73] Assignee: Robert Bosch GmbH, Stuttgart, Germany

[21] Appl. No.: 313,100

[22] PCT Filed: Feb. 5, 1994

[86] PCT No.: PCT/DE94/00115

§ 371 Date: Sep. 30, 1994

§ 102(e) Date: Sep. 30, 1994

[87] PCT Pub. No.: WO94/21015

PCT Pub. Date: Sep. 15, 1994

[30] Foreign Application Priority Data

Mar. 2, 1993 [DE] Germany ..... 43 06 402.7

[51] Int. Cl.[6] ..... H01T 1/12

[52] U.S. Cl. ..... 313/135; 313/136; 313/144

[58] Field of Search ..... 313/135, 144, 313/136; 252/502, 504, 506, 507, 508, 509

[56] References Cited

U.S. PATENT DOCUMENTS

| | | | |
|---|---|---|---|
| 3,909,459 | 9/1975 | Friese . | |
| 3,931,055 | 1/1976 | Friese | 252/504 |
| 4,514,656 | 4/1985 | Damson et al. | 313/129 |

FOREIGN PATENT DOCUMENTS

| | | |
|---|---|---|
| 2245403 | 3/1974 | Germany . |
| 3026374 | 1/1981 | Germany . |
| 3226340C2 | 6/1987 | Germany . |

*Primary Examiner*—Sandra L. O'Shea
*Assistant Examiner*—Vip Patel
*Attorney, Agent, or Firm*—Spencer & Frank

[57] ABSTRACT

An electrically conducting sealing compound for a spark-plug contact core with the sealing compound being disposed between a terminal-side section and a spark-side section of a center electrode, while the sealing compound essentially contains a fusible glass component and a powdered, electrically conducting component. The electrically conducting component of the sealing compound is exclusively composed of graphite in an amount of 10 to 30% by volume, based on the powder components of the sealing compound.

14 Claims, 1 Drawing Sheet

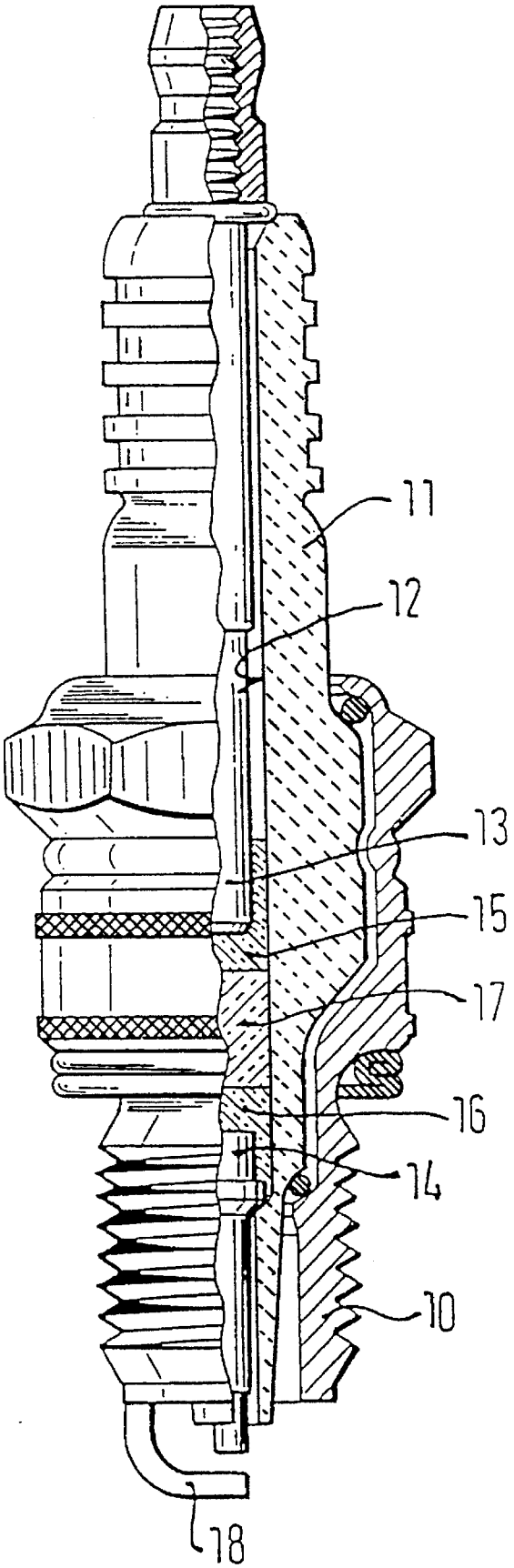
11
12
13
15
17
16
14
10
18

ELECTRICALLY CONDUCTING SEALING COMPOUND FOR SPARK PLUGS

PRIOR ART

The invention relates to an electrically conducting sealing compound for a spark-plug contact core which is disposed between a terminal-side section and a spark-side section of a centre sparkplug electrode and which essentially contains a fusible glass component and a powdered, electrically conducting component. Sealing compounds are used for the leakproof sealing of the centre electrode in the insulator body of the spark plug and for radio interference suppression. The seal is also referred to as a resistance seal. In this connection, the resistance seal comprises a contact core with good electrical conduction on the terminal-side section and on the spark-side section, respectively, of the centre electrode and a resistance core situated in between.

German Patent Specification 22 45 403 discloses a generic contact-core sealing compound containing borosilicate glass as the fusible component and graphite and soot as the electrically conducting component. In addition, it is pointed out that sealing compounds containing only graphite as the conductive component are unsuitable because of the high proportions by volume of graphite required and the difficulties resulting therefrom during the processing and because of the inadequate gas impermeability.

It was observed that spark plugs having a known composition of the sealing compound of the contact core undergo failure under high thermal load because the soot or carbon black contained in the contact core on the central electrode burns out. The replacement of the carbon black by metal powder also proves unsatisfactory because of inadequate stability under high electrical load.

The resistance core is composed of glass and, as fillers, other inorganic additives which do not melt at the sealing temperatures applied, and also of carbon as the electrically conductive component. In this connection, the carbon is added as soot or carbon black and/or by means of an organic binder which forms carbon. German Patent Specification 32 26 340, inter alia, discloses the use of carboxymethylcellulose (CMC) as an organic binder.

SUMMARY AND ADVANTAGES OF THE INVENTION

It was found that the proportion of graphite necessary to function as the sealing core and the contact core for resistance seals does not have to be set so high that the disadvantage mentioned in German Patent Specification 22 45 403 occurs. In contrast to this, the sealing compound according to the invention intended for the contact core and having an electrically conducting component which contains graphite which is, at least approximately, free of crystal structures of carbon black, has the advantage that the sealing compound used to produce the contact core can be processed appreciably better than with the finely divided soot which tends to agglomerate.

The measures disclosed in the specification and specified in the subclaims make advantageous further developments of the basic resistance seal according to the invention possible. Because of the higher tendency to oxidation of fine-grained graphite, it is particularly advantageous if the graphite has as low as possible a grain-size component below 5 μm. The grain size is limited in the upward direction by the number of contact points between the graphite grains, said number becoming ever smaller with increasing grain size. Particularly expedient is as narrow a grain-size distribution as possible, with a mean grain size between approximately 20 and 50 μm, preferably from 30 to 40 μm, while the proportion of the grain size below 10 μm should be lower than 5% and of the grain size over 96 μm should be below 10%. To reduce the oxidation of the graphite, the contact core may contain up to 4% by volume of fine-grained aluminium powder as a reducing agent. A particularly good stability under high electrical load is achieved if, after the sealing compound has been sealed, the contact core on the terminal-side section of the centre electrode is thicker than the contact core on the spark-side centre electrode.

BRIEF DESCRIPTION OF THE DRAWING

An exemplary embodiment of the invention is shown in the drawing and explained in greater detail in the description below. The sole FIGURE shows a spark plug in a sectional representation.

DETAILED DESCRIPTION OF THE EXEMPLARY EMBODIMENT

The spark plug shown in the FIGURE comprises an insulator 11 which is flanged into a metallic spark-plug casing 10 in a gastight manner and in whose insulator bore 12 a terminal-side centre electrode 13 and a spark-side centre electrode 14 are inserted. Inserted in the centre section of the insulator bore 12 is a resistance seal 15, 16, 17 which electrically connects the terminal-side centre electrode 13 to the spark-side centre electrode 14. In the present exemplary embodiment, the resistance seal comprises a first contact core 15 which adjoins the terminal-side centre electrode 13, a second contact core 16 which is in contact with the spark-side centre electrode 14 and a resistance core 17 which is disposed between the two contact cores 15, 16. The composition of the contact cores 15 and 16 and of the resistance core 17 are dealt with further below. The earth electrode of the spark plug is denoted by 18.

In the sealed state, the minimum height between the spark-side centre electrode 14 and the resistance core 17 is 0.5 mm and that between the resistance core 17 and the terminal-side centre electrode 13 is 2 mm. The reason for this requirement resides in the sealing function of the contact cores 15, 16 with respect to incoming oxygen during the sealing process. If oxygen penetrates to the resistance core 17, some of the carbon is oxidized, thereby partially increasing the resistance value. During the operation of the spark plug under high electrical load, more energy is converted at the point with the increased resistance value. This increases the temperature at this point, which may result in the failure of the spark plug.

Resistance sealing compounds or electrically conductive sealing compounds, respectively, are used for the two contact cores 15, 16 and the resistance core 17. In the present exemplary embodiment, the sealing compounds of both the contact cores 15, 16 and of the resistance core 17 contain an Li Ca borosilicate glass of the following composition in percentage by mass:

| | |
|---|---|
| $SiO_2$ | 51 |
| $Al_2O_3$ | 1 |
| CaO | 7 |
| $B_2O_3$ | 37 |
| $Li_2O$ | 4 |

The electrically conducting sealing compound used to produce the contact cores 15, 16 has the following composition in percentage by volume:

| | |
|---|---|
| Glass (grain size 63 to 400 μm) | 64.2 |
| SiC (grain size 150 to 210 μm) | 15.0 |
| Aluminium powder (grain size approx. 8 μm) | 0.8 |
| Graphite (grain size 5 to 80 μm) | 20.0 |

Glass, SiC and the aluminium powder are mixed in the dry state. Then the glass, SiC-grain and aluminium-grain samples are coated with graphite using an aqueous dextrin solution as binder. The proportion of dextrin is approximately 1%. The mixture is then dried. Coarse components are then destroyed or separated off by screening.

To produce the resistance compound, an initial resistance mixture is created. The initial resistance mixture for a 6 kiloohm resistance has the following composition in percentage by mass:

| | |
|---|---|
| Thermal black | 3.7 |
| $ZrO_2$ | 81.0 |
| Glass (grain size < 63 μm) | 15.3 |

The initial resistance mixture is finally combined with further glass and fused corundum in the following composition in percentage by volume:

| | |
|---|---|
| Glass (grain size 63 to 400 μm) | 59.0 |
| Fused corundum (grain size 120 to 250 μm) | 25.0 |
| Initial resistance mixture | 16.0 |

The glass and the fused corundum are mixed in the dry state. Then the coarse glass grains and corundum grains are coated with the preground initial resistance mixture using an aqueous solution of purified Ca carboxymethylcellulose (CMC). The proportion of CMC in the finished resistance compound is 0.1 to 1.0% by mass, preferably 0.2% by mass. The mixture is finally dried and the coarse components are destroyed or separated off by screening. The resistance value of the resistance core 17 can be adjusted by changing the soot component, the initial resistance mixture and the amount of CMC.

To produce the resistance seal, first the electrically conducting sealing compound of the spark-side contact core 16, then the resistance compound of the resistance core 17 and, finally, the electrically conducting sealing compound of the contact core 15 are introduced into the insulator bore 12 of the insulator 11 with the spark-side centre electrode 14 inserted, and precompacted using a ram. The terminal-side centre electrode 13 is placed on the upper contact core 15 and pressed down. The insulator 11 preassembled in this manner is heated to a temperature of 850° to 900° C. At these temperatures, the terminal-side centre electrode 13 is pressed into the softened contact compound of the contact core 15.

The amounts of the electrically conducting sealing compounds and of the resistance compound introduced are chosen so that, after they have been introduced and precompacted, the terminal-side centre electrode 13 projects approximately 6 to 8 mm above the end face of the insulator 11 and so that, after heating and pressing-in the centre electrode 13, the following core heights are obtained:

| | |
|---|---|
| spark-side contact core | 0.5 to 2 mm |
| resistance core | 5 to 8 mm |
| terminal-side contact core | > 2 mm |

Spark plugs having the resistance seal according to the invention were operated in an engine under high thermal load as a comparison with spark plugs having soot and graphite as conductive phase in the contact core. In the case of the spark plugs having the soot-containing contact cores, resistance increases of up to >20 megaohms occurred even after approximately 200 operating hours. In the case of these spark plugs, a marked porous fringe was detectable around the centre electrode head, which fringe had been produced by burning-out of soot due to the high thermal load during the operation of the engine. The spark plugs having the resistance seal according to the invention and in accordance with the exemplary embodiment described exhibited only slight resistance changes even after 500 operating hours and no porosity was detectable around the centre electrode head, which porosity would have indicated an oxidation of the graphite.

The following table shows the test results of contact cores of different composition and height.

| Conductive component in the contact core | Height of contact core on spark-side centre electrode / terminal-side centre electrode | Failures in % *) after h |
|---|---|---|
| Fe + graphite | 1.0 / 3.5 | 25% 100 h |
| Graphite | 2.0 / 4.5 | 0% 200 h |
| Graphite | 1.5 / 1.7 | 18% 90 h |

*) Failure: resistance increase > 30%

We claim:

1. Electrically conducting sealing compound for a spark plug between a terminal-side section and a spark-side section of a centre electrode, which sealing compound essentially contains a fusible glass component and a powdered, electrically conducting component, wherein the electrically conducting component contains graphite which is, at least approximately, free of carbon black, and with the graphite being present in an amount of 10 to 30% by volume, based on the powdered components contained in the sealing compound.

2. Sealing compound according to claim 1, wherein the graphite is free of carbon black.

3. Sealing compound according to claim 2, wherein the graphite has a mean grain size of 20 to 50 μm.

4. Sealing compound according to claim 3, wherein the graphite has a grain size of 30 to 40 μm, the proportion of the grain size below 10 μm is <5%, and the proportion of the mean grain size above 96 μm is <10%.

5. Sealing compound according to claim 1, wherein the graphite is present in an amount of 18 to 22% by volume, based on the powdered components contained in the sealing compound.

6. Sealing compound according to claim 1 wherein: sealing compound is provided in each case on the terminal-side centre electrode and on the spark-side centre electrode, and, after sealing in, the sealing compound on the terminal-side centre electrode is thicker than the sealing compound on the spark-side centre electrode.

7. Sealing compound according to claim 6, wherein a resistance compound is situated between the sealing compound on the terminal-side centre electrode and the sealing compound on the spark-side centre electrode, and in that; the spacing between that end face of the spark-side centre electrode which is on the sealing-compound side and the resistance compound is at least 0.5 mm; and the spacing between that end face of the terminal-side centre electrode which is on the sealing-compound side and the resistance compound is at least 2 mm.

8. Sealing compound according to claim 1, wherein the graphite has a mean grain size of 20 to 50 μm.

9. Sealing compound according to claim 8, wherein the graphite has a grain size of 30 to 40 μm, and the proportion of the grain size below 10 μm is <5%, and the proportion of the mean grain size above 96 μm is <10%.

10. In a spark plug having an electrically conducting sealing compound disposed between a terminal-side section and a spark-side section of a centre spark plug electrode and which essentially contains a fusible glass component and a powdered, electrically conducting component; the improvement wherein:

the electrically conducting component contains graphite which is substantially free of carbon black; the graphite is present in an amount of 10% to 30% by volume, based on the powdered components contained in the sealing compound; the sealing compound is provided in each case on the terminal-side centre electrode and on the spark-side centre electrode; and, after sealing, the sealing compound on the terminal-side centre electrode is thicker than the sealing compound on the spark-side centre electrode.

11. The spark plug defined in claim 10, wherein:

a resistance compound is situated between the sealing compound on the terminal-side centre electrode and the sealing compound on the spark-side centre electrode;

the spacing between that end face of the spark-side centre electrode which is on the sealing-compound side and the resistance compound is at least 0.5 mm; and the spacing between that end face of the terminal-side centre electrode which is on the sealing-compound side and the resistance compound is at least 2 mm.

12. The spark plug defined in claim 10, wherein the graphite is present in an amount of 18 to 22% by volume, based on the powdered components contained in the sealing compound.

13. The spark plug defined in claim 10, wherein the graphite has a mean grain size of 20 to 50 μm.

14. The spark plug defined in claim 13, wherein the graphite has a grain size of 30 to 40 μm, the proportion of the grain size below 10 μm is <5% and the proportion of the grain size above 96 μm is <10%.

* * * * *